US010390636B2

(12) United States Patent
Thompson et al.

(10) Patent No.: US 10,390,636 B2
(45) Date of Patent: Aug. 27, 2019

(54) CANVAS MOUNTING DEVICE

(71) Applicant: 3M INNOVATIVE PROPERTIES COMPANY, St. Paul, MN (US)

(72) Inventors: Craig D. Thompson, Inver Grove Heights, MN (US); David J. Prince, Saint Paul, MN (US); Andrew C. Stansel, Woodbury, MN (US); Michele A. Eller, Stillwater, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 0 days.

(21) Appl. No.: 15/561,926

(22) PCT Filed: Mar. 15, 2016

(86) PCT No.: PCT/US2016/022405

§ 371 (c)(1),
(2) Date: Sep. 26, 2017

(87) PCT Pub. No.: WO2016/160323

PCT Pub. Date: Oct. 6, 2016

(65) Prior Publication Data

US 2018/0116431 A1 May 3, 2018

Related U.S. Application Data

(60) Provisional application No. 62/139,124, filed on Mar. 27, 2015.

(51) Int. Cl.
*A47G 1/17* (2006.01)
*A47G 1/16* (2006.01)

(52) U.S. Cl.
CPC ..... *A47G 1/175* (2013.01); *A47G 1/1633* (2013.01)

(58) Field of Classification Search
USPC ..... 248/475.1, 488, 477, 490, 467, 683, 248/205.3; D8/354, 373
See application file for complete search history.

(56) References Cited

U.S. PATENT DOCUMENTS

| | | | |
|---|---|---|---|
| 2,488,925 | A | 11/1949 | Miller |
| 3,353,663 | A | 11/1967 | Kayser |
| 3,408,705 | A | 11/1968 | Kayser |
| 3,471,903 | A | 10/1969 | Northrup |
| 4,120,718 | A | 10/1978 | Hudalla |

(Continued)

FOREIGN PATENT DOCUMENTS

| | | |
|---|---|---|
| CN | 101653333 | 2/2010 |
| DE | 202011101452 | 11/2011 |

(Continued)

OTHER PUBLICATIONS

International Search Report for PCT International Application No. PCT/US2016/22405, dated May 27, 2016, 3 pages.

*Primary Examiner* — Alfred J Wujciak
(74) *Attorney, Agent, or Firm* — Kevin Weber

(57) ABSTRACT

The present disclosure relates generally to various improved mounting devices. Some embodiments relate to a mounting device, comprising: a bracket that can be attached to or mounted on a vertical surface with one or more adhesive strips; and one or more mechanical features on the bracket that prevent or minimize an item hung on the bracket from sliding horizontally off the bracket.

13 Claims, 6 Drawing Sheets

(56) References Cited

U.S. PATENT DOCUMENTS

| | | | | | |
|---|---|---|---|---|---|
| 4,216,257 | A | | 8/1980 | Schams | |
| 4,223,067 | A | | 9/1980 | Levens | |
| 4,262,874 | A | * | 4/1981 | Seigh | A47G 1/1646 248/467 |
| 4,290,832 | A | | 9/1981 | Kalleberg | |
| 4,300,692 | A | * | 11/1981 | Moreno | A47F 5/0853 211/87.01 |
| 4,322,875 | A | | 4/1982 | Brown | |
| 4,391,687 | A | | 7/1983 | Vesley | |
| 4,415,615 | A | | 11/1983 | Esmay | |
| 4,454,183 | A | | 6/1984 | Wollman | |
| 4,458,873 | A | | 7/1984 | Sutherland | |
| 4,563,388 | A | | 1/1986 | Bonk | |
| 4,606,526 | A | | 8/1986 | Rabinowitz | |
| 4,610,418 | A | | 9/1986 | Graham | |
| 4,679,851 | A | | 7/1987 | Solie | |
| 4,699,622 | A | | 10/1987 | Toussant | |
| 4,776,636 | A | | 10/1988 | Pyle | |
| 4,804,161 | A | | 2/1989 | Wallo | |
| 4,819,309 | A | | 4/1989 | Behymer | |
| 4,887,339 | A | | 12/1989 | Bellanger | |
| 4,894,060 | A | | 1/1990 | Nestegard | |
| 4,910,062 | A | | 3/1990 | Zinke | |
| 4,977,003 | A | | 12/1990 | Brown | |
| 4,985,488 | A | | 1/1991 | Landin | |
| 5,024,880 | A | | 6/1991 | Veasley | |
| 5,040,275 | A | | 8/1991 | Eckhardt | |
| 5,077,870 | A | | 1/1992 | Melbye | |
| 5,135,598 | A | | 8/1992 | Kobe | |
| 5,145,929 | A | | 9/1992 | Ou-Yang | |
| 5,149,573 | A | | 9/1992 | Kobe | |
| 5,308,428 | A | | 5/1994 | Simpson | |
| 5,312,387 | A | | 5/1994 | Rossini | |
| 5,344,691 | A | | 9/1994 | Hanschen | |
| 5,399,219 | A | | 3/1995 | Roessler | |
| 5,453,319 | A | | 9/1995 | Gobran | |
| 5,487,809 | A | | 1/1996 | Goulait | |
| 5,537,722 | A | | 7/1996 | Niederhofer | |
| 5,554,146 | A | | 9/1996 | Niederhofer | |
| 5,593,120 | A | * | 1/1997 | Hamerski | B29C 65/0672 156/235 |
| 5,598,610 | A | | 2/1997 | Torigoe | |
| 5,602,221 | A | | 2/1997 | Bennett | |
| 5,605,313 | A | * | 2/1997 | Erickson | A47G 1/1606 248/467 |
| 5,614,232 | A | | 3/1997 | Torigoe | |
| 5,625,929 | A | | 5/1997 | Hattori | |
| 5,654,487 | A | | 8/1997 | Cooley | |
| 5,671,511 | A | | 9/1997 | Hattori | |
| 5,671,512 | A | | 9/1997 | Hattori | |
| 5,679,302 | A | | 10/1997 | Miller | |
| 5,691,021 | A | | 11/1997 | Kobe | |
| 5,691,027 | A | | 11/1997 | Eckhardt | |
| 5,705,013 | A | | 1/1998 | Nease | |
| 5,713,111 | A | | 2/1998 | Hattori | |
| 5,749,558 | A | | 5/1998 | Wallo | |
| 5,759,317 | A | | 6/1998 | Justmann | |
| 5,851,205 | A | | 12/1998 | Hisada | |
| 5,851,663 | A | | 12/1998 | Parsons | |
| 5,852,855 | A | | 12/1998 | Mody | |
| 5,908,695 | A | | 6/1999 | Kobe | |
| 5,957,908 | A | | 9/1999 | Kline | |
| 5,985,081 | A | | 11/1999 | Reynolds | |
| 6,030,373 | A | | 2/2000 | VanGompel | |
| 6,051,094 | A | | 4/2000 | Melbye | |
| 6,075,179 | A | | 6/2000 | McCormack | |
| 6,076,238 | A | | 6/2000 | Arsenault | |
| 6,190,758 | B1 | | 2/2001 | Stopper | |
| 6,406,468 | B1 | | 6/2002 | Dilnik | |
| 6,470,540 | B2 | | 10/2002 | Aamodt | |
| 6,544,245 | B2 | | 4/2003 | Neeb | |
| 6,572,943 | B2 | * | 6/2003 | Shaffer | A47G 1/17 248/467 |
| 6,572,945 | B2 | | 6/2003 | Bries | |
| 6,575,953 | B2 | | 6/2003 | Olson | |
| 6,588,074 | B2 | | 7/2003 | Galkiewicz | |
| 6,592,800 | B1 | | 7/2003 | Levitt | |
| 6,630,239 | B2 | | 10/2003 | Cernohous | |
| 6,692,807 | B2 | | 2/2004 | Bries | |
| 6,874,777 | B2 | | 4/2005 | Sano | |
| 7,032,278 | B2 | | 4/2006 | Kurtz, Jr. | |
| 7,125,400 | B2 | | 10/2006 | Igaue | |
| 7,140,774 | B2 | | 11/2006 | Galkiewicz | |
| 7,217,455 | B2 | | 5/2007 | Valdez | |
| 7,361,246 | B2 | | 4/2008 | Chang | |
| 7,371,302 | B2 | | 5/2008 | Miyamoto | |
| 7,517,572 | B2 | | 4/2009 | Val Dyke | |
| 7,578,812 | B2 | | 8/2009 | Datta | |
| 7,658,813 | B2 | | 2/2010 | Peterson | |
| 7,703,179 | B2 | | 4/2010 | Ferguson | |
| 7,879,441 | B2 | | 2/2011 | Gehlsen | |
| 8,277,922 | B2 | | 10/2012 | Tuman | |
| 8,777,919 | B2 | | 7/2014 | Kimura | |
| 2004/0010217 | A1 | | 1/2004 | Blette | |
| 2005/0006552 | A1 | * | 1/2005 | Giles | A47G 1/168 248/467 |
| 2008/0035825 | A1 | | 2/2008 | Torrey | |
| 2009/0013508 | A1 | * | 1/2009 | zu Putlitz | A47G 1/175 24/584.1 |
| 2010/0096532 | A1 | | 4/2010 | Greve | |
| 2011/0024585 | A1 | | 2/2011 | Brinkdopke | |
| 2012/0112022 | A1 | * | 5/2012 | Cheng | A47G 7/044 248/205.3 |
| 2014/0166829 | A1 | | 6/2014 | Thompson | |
| 2014/0326848 | A1 | | 11/2014 | Popkin | |

FOREIGN PATENT DOCUMENTS

| | | |
|---|---|---|
| EP | 2644060 | 10/2013 |
| FR | 2864885 | 7/2005 |
| FR | 2939293 | 6/2011 |
| GB | 2439284 | 12/2007 |

* cited by examiner

CANVAS MOUNTING DEVICE

CROSS REFERENCE TO RELATED APPLICATIONS

This application is a national stage filing under 35 U.S.C. 371 of PCT/US2016/022405, filed Mar. 15, 2016, which claims the benefit of provisional Application No. 62/139,124, filed Mar. 27, 2015, the disclosure of which is incorporated by reference in its/their entirety herein.

TECHNICAL FIELD

The present disclosure relates generally to various mounting devices that may, in some embodiments, be especially useful for mounting a canvas.

BACKGROUND

FIGS. 1A and 1B are respective front-side and back-side photographs of an exemplary prior art stretched canvas (e.g., a canvas stretched across a frame). Stretched canvas 100 includes a frame 110 (typically wood or pressed wood) and a canvas 120 wrapped around the frame edges. Typical methods for hanging the stretched canvas include, for example, the use of nails, wire hooks, J hooks, saw tooth brackets, or D-rings.

SUMMARY

The inventors of the present disclosure recognized that the existing methods and mounting devices for hanging a stretched canvas could be improved. For example, non-damaging mounting devices may be desirable. To that end, the inventors of the present disclosure invented various mounting devices capable of hanging or mounting a stretched canvas to a wall or vertical surface.

Some embodiments of the present disclosure relate to a bracket that can be attached to or mounted on a wall with one or more adhesive strips. In some embodiments, the wall-mounted bracket is capable of holding, for example, a stretched canvas painting and has one or more mechanical features that prevent or minimize the canvas from sliding horizontally off of the bracket. In some embodiments, the mechanical features that prevent or minimize the canvas from sliding horizontally off of the bracket are teeth or protrusions.

Some embodiments relate to a mounting device, comprising: a bracket that can be attached to or mounted on a vertical surface with one or more adhesive strips; and one or more mechanical features on the bracket that prevent or minimize an item hung on the bracket from sliding horizontally off the bracket. In some embodiments, the item is a stretched canvas. In some embodiments, the bracket comprises a backplate and a generally horizontal plate; and one or more teeth on the generally horizontal plate. In some embodiments, the bracket comprises a backplate attached to or integral with a generally horizontal plate; and a lip attached to or integral with the generally horizontal plate. In some embodiments, the lip includes one or more teeth. In some embodiments, the bracket includes a plate attached to or integral with a generally u-shaped apparatus; and an attachment or fastening portion on the topmost side of the u-shaped apparatus capable of adhering the mounting device to a stretched canvas. In some embodiments, the adhesive strips are picture hanging strips.

The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

DETAILED DESCRIPTION

The present disclosure will be described more fully hereinafter with reference to the accompanying drawings, in which exemplary embodiments are shown. The scope of this disclosure, however, may be embodied in many different forms and should not be construed as limited to the embodiments set forth or shown herein.

Figure 1A:
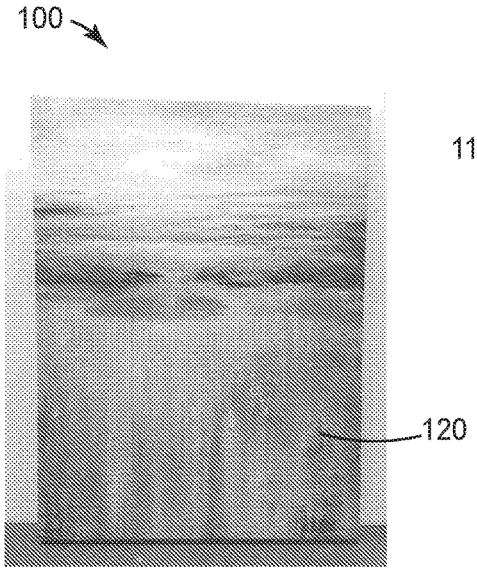
FIGS. 1A and 1B are respective front-side and back-side photographs of an exemplary prior art stretched canvas.
Figure 1B:
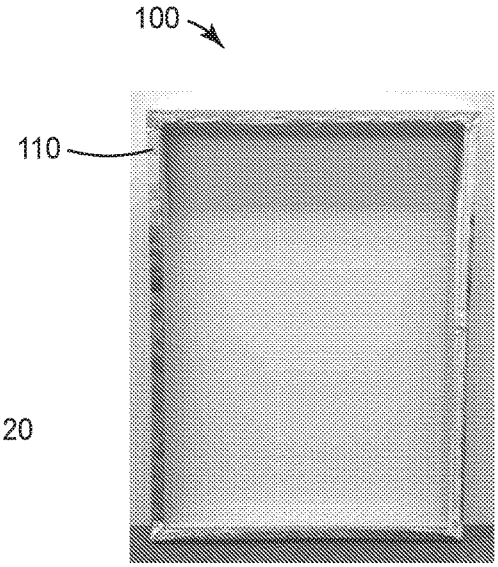
Figure 2A:
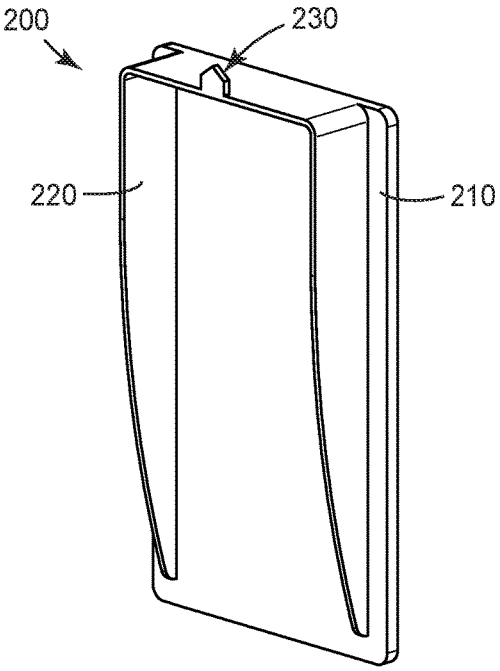
FIG. 2A is a perspective view schematic of an exemplary mounting device of the type generally described herein.
Figure 2B:
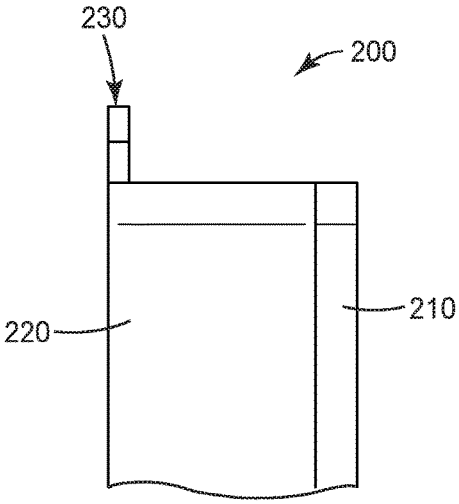
FIG. 2B is a side view of the mounting device of FIG. 2A.

One exemplary mounting device of the type generally described herein is shown in FIGS. 2A and 2B. Mounting device 200 includes a plate 210 attached to or integral with a generally u-shaped apparatus 220 that together form a bracket. A tooth 230 extends upwardly from u-shaped apparatus 220. In some embodiments, tooth 230 has a sharp beveled edge (as shown in FIGS. 2A and 2B). In some embodiments, the bevel side of tooth 230 is away from the wall side of the bracket, which may be preferred so that the sharp beveled edge will bite into the wood frame of the stretched canvas if it begins to slide horizontally from the wall or vertical surface. Adhesive strips (e.g., picture hanging adhesive strips) can be applied to the back of mounting device 200 to adhere or apply the mounting device to a horizontal surface, such as a wall.

Those of skill in the art will appreciate that tooth 230 as shown can be replaced with many similar-functioning designs, such as, for example, an inserted metal tooth or conical point. Those of skill in the art will appreciate that the mounting device can be any desired size and can be made of any desired materials. For example, the u-shaped apparatus can be any shape including, for example, a V-shaped apparatus, a T-shaped apparatus, etc. Those of skill in the art will appreciate that the mounting device can be used to hang or mount any desired item including, for example, a stretched canvas, a canvas, a decorative item, a photo, a frame, etc. Those of skill in the art will appreciate that many changes may be made to the specific embodiment shown without departing from the general teachings herein.

Figure 3A:
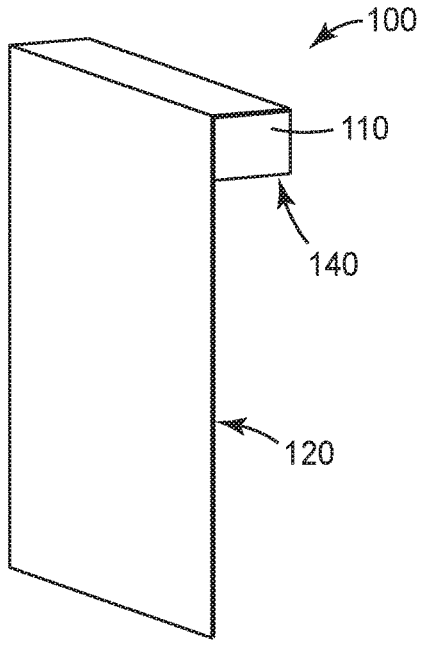
FIG. 3A is a perspective view schematic cutaway of an exemplary stretched canvas.
Figure 3B:
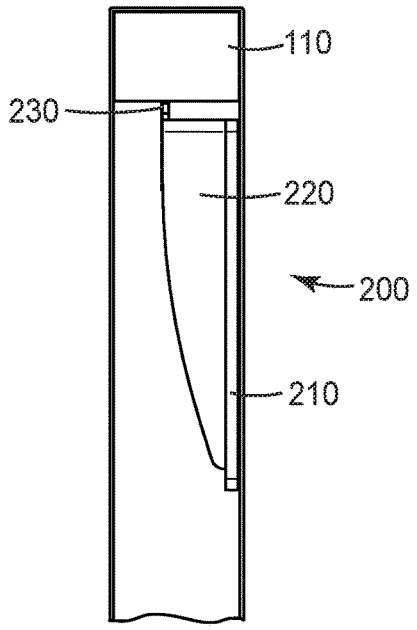
FIG. 3B is a side of an exemplary embodiment in accordance with the teachings herein.

FIGS. 3A and 3B schematically show how the exemplary embodiment of a mounting device of FIGS. 2A and 2B can be used with an exemplary stretched canvas. FIG. 3A is a perspective view schematic cutaway of an exemplary stretched canvas (the long side of the stretched canvas has been removed to show how the upper edge 140 of the canvas frame 110 rests on the mounting device 200). The stretched canvas of FIG. 3A sits atop mounting device 200 in FIG. 3B. Tooth 230 fixes and securely holds the stretched canvas in place and/or in position on mounting device 200. Tooth 230 prevents or minimizes the incidence of the stretched canvas from sliding horizontally off of the mounting device 200. Adhesive strips (e.g., picture hanging adhesive strips) can be applied to the back of mounting device 400 to adhere or apply the mounting device to a horizontal surface, such as a wall. FIG. 3B shows how the mounting device can be tucked under the upper frame of the stretched canvas and the approximate point of contact of the tooth (for this specific embodiment). This permits the stretched canvas to be generally flush with the vertical surface or wall (a significant benefit over existing product offerings). Those of skill in the art will appreciate that the mounting device can be any desired size and can be made of any desired materials. Those of skill in the art will appreciate that many changes may be made to the specific embodiment shown.

Figure 4A:
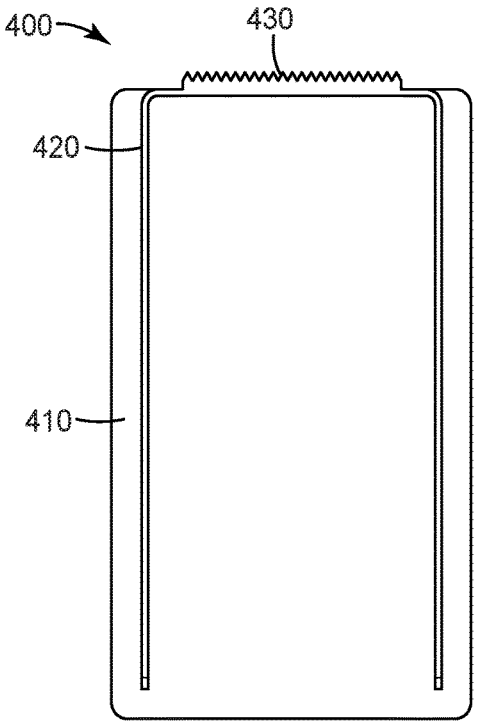
FIGS. 4A-4C are respective back-side, side view, and perspective schematics of another exemplary mounting device of the type generally described herein.
Figure 4B:
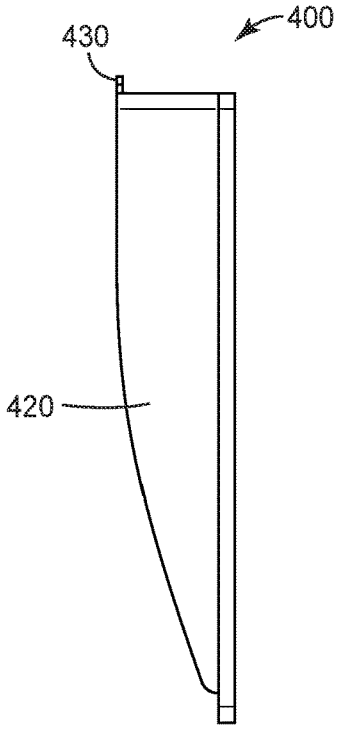
Figure 4C:
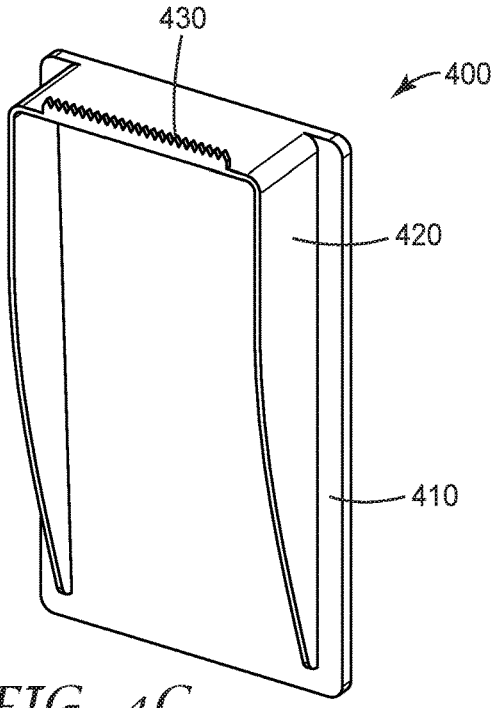

Another exemplary mounting device of the type generally described herein is shown in FIGS. 4A-4C. FIGS. 4A-4C are respective back-side, side view, and perspective schematics of another exemplary mounting device 400. Mounting device 400 includes a plate 410 attached to or integral with a generally u-shaped apparatus 420 that together form a bracket. A plurality of teeth 430 extend upwardly from the bracket. One advantage provided by teeth 430 is that they allow or facilitate a canvas picture to be hung level or leveled even if the canvas hanger was not placed on the wall level. As shown in the specific embodiment of FIGS. 4A-4C, the teeth can be multiple, smaller teeth spaced in a radial pattern. Alternatively, the teeth can be in a row and/or can be straight. One advantage of this embodiment is that if the mounting device is accidentally mounted on the wall at an angle, the multiple tooth options permit the user to select the tooth that will permit the stretched canvas to hang straight on the wall without having to remove, reposition, and reapply the mounting device. Adhesive strips (e.g., picture hanging adhesive strips) can be applied to the back of mounting device 400 to adhere or apply the mounting device to a vertical surface, such as a wall. Those of skill in the art will appreciate that the mounting device can be any desired size and can be made of any desired materials. Those of skill in the art will appreciate that many changes may be made to the specific embodiments shown.

Figure 5A:
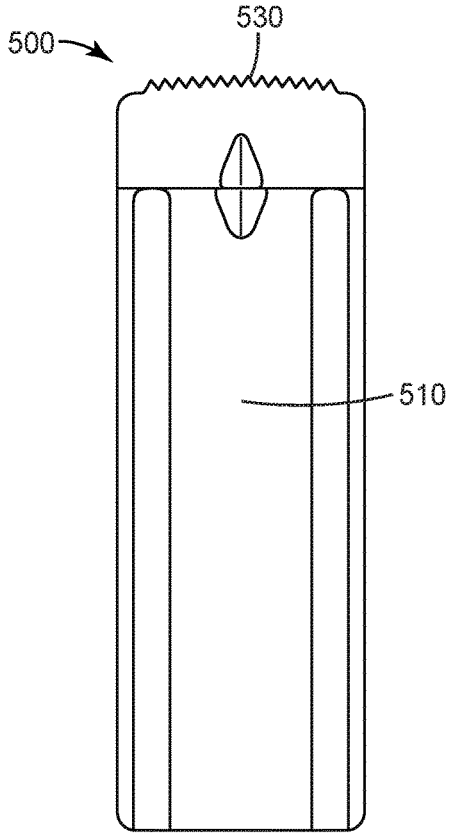
FIGS. 5A-5C are respective front, side, and perspective views of another exemplary mounting device of the type generally described herein.
Figure 5B:
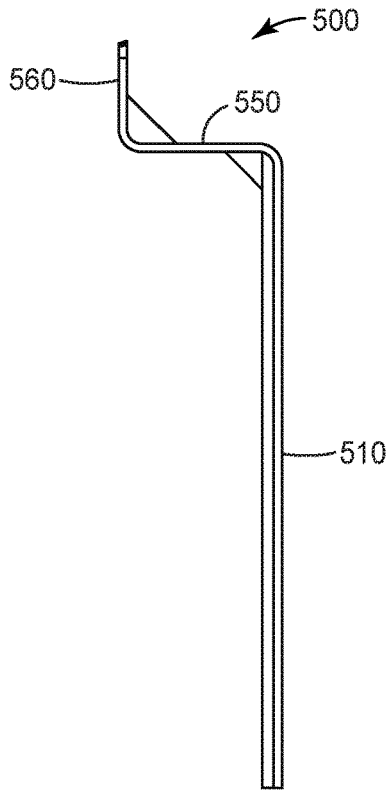
Figure 5C:
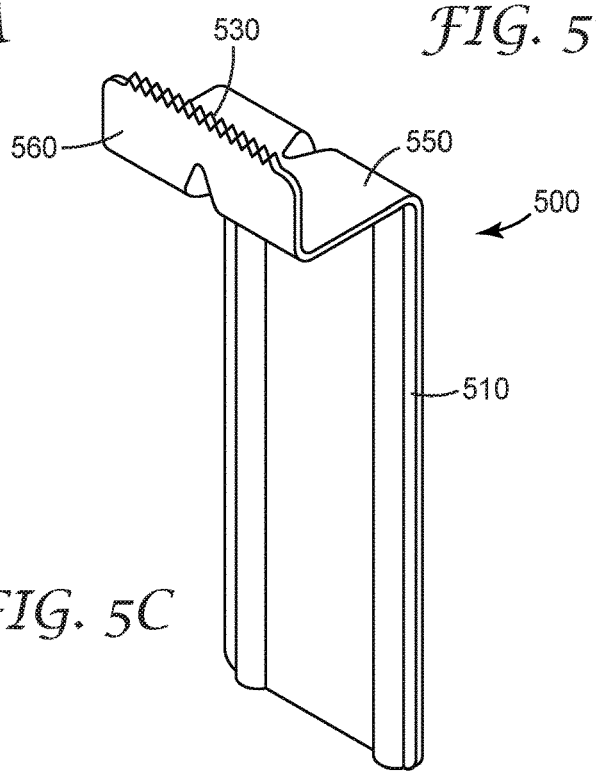

FIGS. 5A-5C are respective front, side, and perspective views of another exemplary mounting device of the type generally described herein. Mounting device 500 includes a backplate 510 attached or adjacent to or integral with a generally horizontal plate 550 that is attached to or adjacent to a backplate 510, generally horizontal plate 550, and lip 560 together form a bracket. In some embodiments, lip 560 includes one or more teeth 530 that extend upwardly from lip 560. As is described herein, the teeth can be, for example, in a straight, row, and/or radial pattern. One advantage provided by teeth 530 is that they allow or facilitate a canvas picture to be hung level or leveled even if the canvas hanger was not placed on the wall level. Adhesive strips (e.g., picture hanging adhesive strips) can be applied to the back of backplate 510 to adhere or apply the mounting device to a vertical surface, such as a wall. When in use, a portion of the frame of a stretched canvas rests on generally horizontal plate 550. Lip 560 and teeth 530 prevent or minimize the stretched canvas from sliding horizontally off of mounting device 500. Those of skill in the art will appreciate that the mounting device can be any desired size and can be made of any desired materials. Those of skill in the art will appreciate that many changes may be made to the specific embodiment shown.

In some embodiments, the bracket is formed from sheet metal, and the sharp teeth are broached during a stamping/forming process.

Figure 6A:
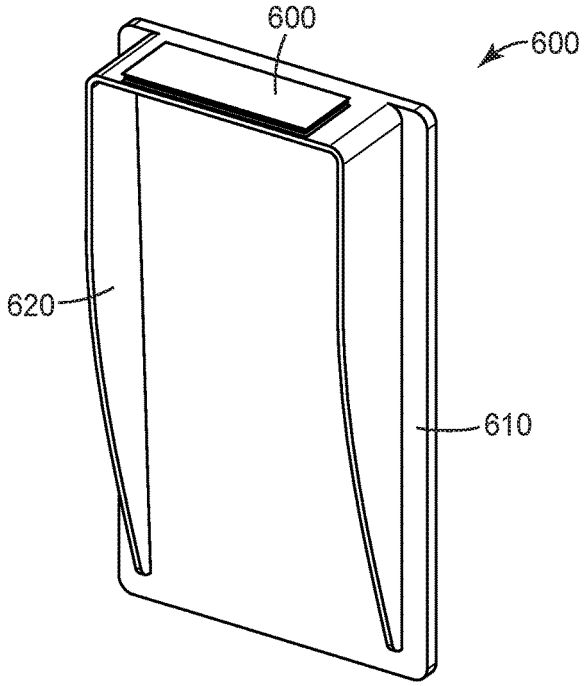
FIGS. 6A and 6B are respective perspective schematics of the back-side of another exemplary embodiments of mounting devices of the type generally described herein.
Figure 6B:
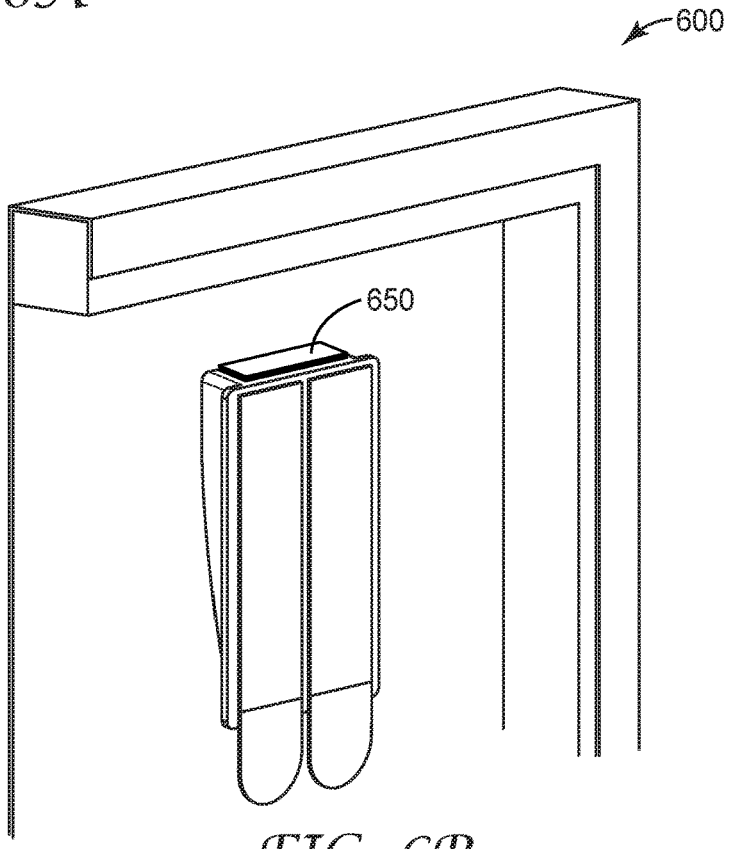
Figure 6C:
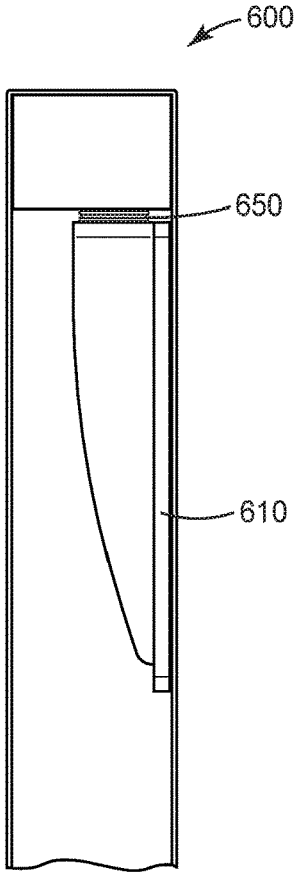
FIGS. 6C and 6D are side view schematics generally showing how mounting devices of the types generally shown in FIGS. 6A and 6B can be applied.
Figure 6D:
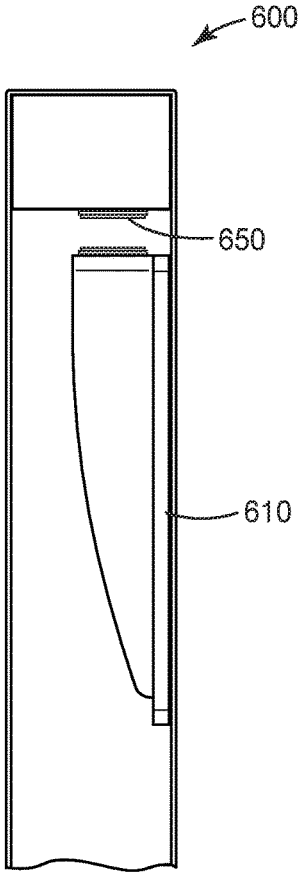

FIGS. 6A and 6B are respective front and back perspective views of an exemplary embodiment of a mounting device of the type generally described herein. FIGS. 6C and 6D are side view schematics generally showing how mounting devices of the types generally shown in FIGS. 6A and 6B can be applied to a stretched canvas. Mounting device 600 includes a plate 610 attached to or integral with a generally u-shaped apparatus 620 that together form a bracket. An attachment or fastening portion 650 (e.g., adhesive strips, Scotchmate™ products, picture hanging strips, a loop-engaging material such as, for example, 3M Dual Lock™) on the topmost side of the u-shaped apparatus portion of the bracket adheres the mounting device 600 to a stretched canvas (as shown, for example, in FIGS. 6C and 6D). In some embodiments, the lower half of the fastener is attached to the bracket, and the adhesive liner on the supper half of the fastener is removed prior to hanging the canvas picture. As such, lateral movement of the stretched canvas is prevented or minimized. Adhesive strips can be applied to the back of mounting device 600 to adhere or apply the mounting device to a vertical surface, such as a wall (as is shown in FIG. 6B).

Any known loop-engaging material can be used. The loop-engaging portion/material can have any desired length or thickness. One exemplary commercially available loop-engaging material is 3M™ Dual-Lock™ fastener. Any loop-engaging material, apparatus, device, method of making, or method of use described in any of the following references (all of which are incorporated herein in their entirety) can be used in any of the embodiments described herein: U.S. Pat. Nos. 8,777,919; 4,699,622; 4,894,060; 5,077,870; 5,312,387; 5,344,691; 5,399,219; 5,487,809; 5,537,722; 5,554,146; 5,705,013; 5,759,317; 5,851,205; 5,957,908; 5,985,081; 6,030,373; 6,051,094; 6,075,179; 6,190,758; 6,406,468; 6,544,245; 6,575,953; 7,032,278; 7,125,400; 7,361,246; 7,371,302; 7,517,572; 7,578,812; 7,658,813; 3,471,903; 4,120,718; 4,223,067; 4,216,257; 4,391,687; 4,322,875; 4,415,615; 4,454,183; 4,563,388; 3,353,663; 3,408,705; 4,977,003; 4,679,851; 4,819,309; 4,776,636; 5,308,428; 5,135,598; 4,910,062; 4,887,339; 4,985,488; 5,679,302; 4,894,060; 5,145,929; 5,908,695; 5,024,880; 5,852,855; 5,040,275; 5,149,573; 4,290,832; 5,453,319; 5,614,232; 5,691,027; 5,713,111; 5,671,512; 5,625,929; 5,671,511; 5,851,663; 5,654,487; 5,602,221; 5,598,610; 5,691,021; 7,879,441; 8,277,922; 6,470,540; 6,076,238; 6,592,800; 6,630,239; 6,588,074; 7,217,455; 7,703,179, 6,874,777; 7,140,774; and US Patent Publication No. 2004/0010217.

Those of skill in the art will appreciate that the mounting device can be any desired size and can be made of any desired materials. Those of skill in the art will appreciate that many changes may be made to the specific embodiments shown.

Figure 7A:
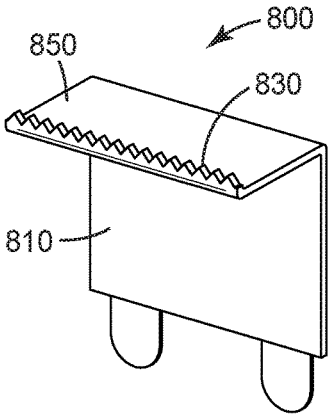
FIG. 7A is a perspective back view schematic of another exemplary mounting device of the type generally described herein.
Figure 7B:
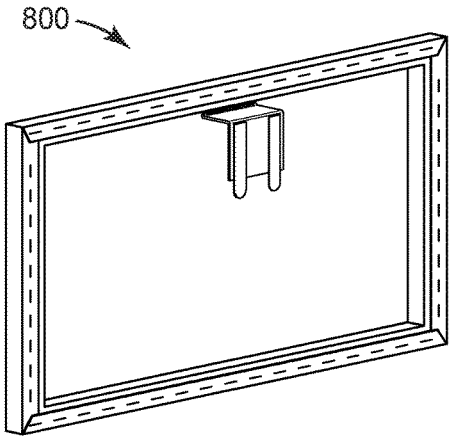
FIG. 7B is a perspective back view of the mounting device of FIG. 7A in use on a stretched canvas.

FIG. 7A is a perspective back view schematic of another exemplary mounting device of the type generally described herein. FIG. 7B is a perspective back view of the mounting device of FIG. 7A in use on a stretched canvas. Mounting device 800 is substantially similar to the mounting device shown in FIGS. 5A-5B except that the mounting device and backplate are wider and include two adhesive strips. Mounting device 800 includes a backplate 810 attached or adjacent to or integral with a generally horizontal plate 850 that is attached to or adjacent to one or more teeth 830 that extend slightly upwardly from generally horizontal plate 850. Adhesive strips (e.g., picture hanging adhesive strips) can be applied to the back of backplate 810 to adhere or apply the mounting device to a vertical surface, such as a wall. When in use, a portion of the frame of a stretched canvas rests on generally horizontal plate 850. Teeth 830 prevent or minimize the stretched canvas from sliding horizontally off of mounting device 800. Those of skill in the art will appreciate that the mounting device can be any desired size and can be made of any desired materials. Those of skill in the art will appreciate that many changes may be made to the specific embodiment shown.

All of the embodiments described herein can be used with 3M™ COMMAND™ Adhesive Strips or Picture Hanging Strips. In some embodiments, the adhesive strips are picture hanging strips such as, for example, those described in U.S. Pat. Nos. 6,692,807 and 6,572,945, both of which are incorporated herein in their entirety. In general, picture hanging strips, as used herein, refer to an adhesive tape construction that is removable from one or more objects to which it is adhered and which is reusably separable within its construction so that an object can be separated from another and subsequently reconnected with one another. The adhesive tape construction can be used to bond the other opposed surfaces of objects, including rigid objects such as a picture frame to a wall, where no portion of the adhesive tape construction projects from between the objects, and which subsequently affords easy separation of the objects without damage to either of them. More specifically, the adhesive tape construction can include a stretch release adhesive tape structure combined with a reusable connector surface. Exemplary commercially available picture hanging strips include 3M™ COMMAND™ Picture Hanging Strips.

Those having skill in the art will appreciate that many changes may be made to the details of the above-described embodiments and implementations without departing from the underlying principles thereof. Further, various modifications and alterations of the present disclosure will become apparent to those skilled in the art without departing from the spirit and scope of the disclosure. The scope of the present disclosure should, therefore, be determined only by the following claims.

What is claimed is:

1. A mounting device for hanging an item, comprising:

a bracket that can be attached to or mounted on a vertical surface with one or more adhesive strips, the bracket including a backplate having opposed front and rear surfaces and opposing side edges, a generally u-shaped apparatus including a generally horizontal plate extending outwardly from the front surface of the backplate, the generally horizontal plate including opposing top and bottom major surfaces; and one or more mechanical features on at least the generally horizontal plate that prevent or minimize the item hung on the bracket from sliding horizontally off the bracket, wherein at least one mechanical feature extends upwards from the horizontal plate in the same direction as a top edge of the backplate, and wherein a width of the generally u-shaped apparatus is less than the width of the backplate as measured between the side edges.

2. The mounting device of claim 1, wherein the at least one the mechanical feature comprises one or more teeth on the generally horizontal plate.

3. The mounting device of claim 2, wherein the bracket comprises a lip attached to or integral with the generally horizontal plate.

4. The mounting device of claim 3, wherein the lip includes the one or more teeth.

5. The mounting device of claim 1, wherein the bracket comprises:

an attachment or fastening portion on the topmost side of the generally horizontal plate capable of adhering the mounting device to an item.

6. The mounting device of claim 5, wherein the attachment or fastening portion is at least one of an adhesive strip, an adhesive, a picture hanging strip, and/or a loop-engaging material.

7. The mounting device of claim 1, wherein the item is at least one of a canvas, stretched canvas, decorative item, photograph, or picture frame.

8. The mounting device of claim 1, wherein the generally horizontal plate is disposed on the backplate adjacent the top edge.

9. The mounting device of claim 1, wherein the u shaped apparatus includes sidewalls extending parallel to one or more side edges of the backplate.

10. The mounting device of claim 9, wherein the sidewalls taper in height as the sidewalls approach a bottom edge of the backplate.

11. The mounting device of claim 1, wherein a rear surface of the backplate includes one or more adhesive strips.

12. The mounting device of claim 1, wherein the generally horizontal plate includes an outermost edge spaced from the front surface of the backplate, and wherein at least one mechanical features is located adjacent the outermost edge.

13. The mounting device of claim 1, wherein the generally horizontal plate includes an outermost edge spaced from the front surface of the backplate, and wherein at least one mechanical feature is located adjacent the outermost edge, wherein the at least one mechanical feature includes either; a) a plurality of teeth or; b) an attachment or fastening portion.

* * * * *